US009212669B2

(12) United States Patent
Krohn

(10) Patent No.: US 9,212,669 B2
(45) Date of Patent: Dec. 15, 2015

(54) PNEUMATIC EVACUATION PUMP

(75) Inventor: Mark Krohn, Caboolture (AU)

(73) Assignee: Pentair Flow Services AG, Schaffhausen (CH)

( * ) Notice: Subject to any disclaimer, the term of this patent is extended or adjusted under 35 U.S.C. 154(b) by 548 days.

(21) Appl. No.: 12/996,261

(22) PCT Filed: Jun. 4, 2008

(86) PCT No.: PCT/AU2008/000800

§ 371 (c)(1),
(2), (4) Date: Dec. 3, 2010

(87) PCT Pub. No.: WO2009/146479

PCT Pub. Date: Dec. 10, 2009

(65) Prior Publication Data

US 2011/0091333 A1 Apr. 21, 2011

(51) Int. Cl.

| | |
|---|---|
| ***F04F 5/24*** | (2006.01) |
| ***F04F 5/34*** | (2006.01) |
| ***F04F 1/02*** | (2006.01) |

(52) U.S. Cl.

CPC ... *F04F 5/24* (2013.01); *F04F 1/02* (2013.01); *F04F 5/34* (2013.01)

(58) Field of Classification Search

CPC ..... F04F 5/04; F04F 5/08; F04F 5/10; F04F 5/14; F04F 5/24; F04F 5/34; F04F 5/44; F04F 5/46; F04F 5/22

USPC ..... 417/103, 109, 111, 120, 144, 151, 165; 406/50, 149, 153

See application file for complete search history.

(56) References Cited

U.S. PATENT DOCUMENTS

| | | | | |
|---|---|---|---|---|
| 1,423,198 | A * | 7/1922 | Davenport | 417/174 |
| 2,193,738 | A * | 3/1940 | Perrin | 406/169 |
| 3,861,830 | A * | 1/1975 | Johnson | 417/149 |
| 4,501,518 | A | 2/1985 | Smith | |
| 4,545,410 | A * | 10/1985 | Paul et al. | 141/18 |
| RE33,084 | E * | 10/1989 | Ranson | 406/50 |
| 5,033,914 | A * | 7/1991 | Wuertele et al. | 406/109 |
| 6,085,939 | A | 7/2000 | Geweke et al. | |
| 8,215,877 | B2 * | 7/2012 | Rieger et al. | 406/96 |
| 2005/0207901 | A1 * | 9/2005 | Klobucar et al. | 417/182 |
| 2005/0268499 | A1 * | 12/2005 | Weinrib et al. | 37/326 |
| 2008/0075606 | A1 * | 3/2008 | Krohn | 417/307 |

FOREIGN PATENT DOCUMENTS

| | | |
|---|---|---|
| GB | 2267315 A | 12/1993 |

* cited by examiner

*Primary Examiner* — Bryan Lettman
*Assistant Examiner* — Charles W Nichols
(74) *Attorney, Agent, or Firm* — Quarles & Brady LLP

(57) ABSTRACT

A pneumatic evacuation pump includes an inlet assembly having an inlet valve, a charging port, and purge air injection means. A chamber includes a charge end opening to the charging port, and a discharge end. A delivery assembly includes a passage between the discharge end and a delivery outlet, a delivery valve interposed in the passage between the discharge end and the delivery outlet, and a venturi vacuum source opening to the passage between a discharge valve and the discharge end. Exhaust air injection means located downstream of the discharge valve utilizes exhaust air from the venturi vacuum source. A compressed air supply supplies the venturi vacuum source and the purge air injection means. Control means acts to coordinate a cycle of operation of the venturi vacuum source, the purge air injection means, the exhaust air injection means and the inlet and delivery valves.

14 Claims, 2 Drawing Sheets

PNEUMATIC EVACUATION PUMP

FIELD OF THE INVENTION

This invention relates to a pneumatic evacuation pump. This invention has particular application to a pneumatic evacuation pump for transporting drilling muds and other mining and drilling liquid flows including entrained materials, and for illustrative purposes the invention will be described with reference to this application. However we envisage that this invention may find use in other applications such as transporting particulates entrained in fluid flows generally such as transporting wet, damp or dry solids, muddy products, slurries and liquids and grains.

BACKGROUND OF THE INVENTION

The reference to any prior art in this specification is not, and should not be taken as, an acknowledgement or any form of suggestion that the referenced prior art forms part of the common general knowledge in Australia.

Belt and auger conveyors are not constraining of the material and/or have a high maintenance requirement. Impeller pumps of are less than suitable due to the impeller coming into contact with the abrasive mixtures.

Pneumatically operated pumps for entrained particulate materials find increasing use, particularly in offshore and terrestrial drilling applications. The technology provides large throughputs with pumps of a minimum number of moving parts, and which can be hardened or provided with cheap sacrificial parts to accommodate, hot, corrosive and/or highly erosive material flows. The use of pneumatic power may substantially remove electrical componentry from an aggressive environment.

WO/2006/037186 describes pump apparatus including a housing having a material inlet for a material to be pumped and a delivery outlet, a valve on each of the inlet and outlet, and control means for selectively opening and closing the respective valves and cycle the pressure in the housing. When the pressure is low in the housing while the inlet valve is open, material is admitted to housing. When the control means effects closure of the inlet valve, the housing is pressurized and the outlet valve is open to discharge said material from said housing. The pressure cycling is achieved with compressed air and a venturi. This apparatus can be entirely pneumatic in operation, avoiding reliance on electronics for its fundamental operation.

In order to scale throughput, multiples of the units may be used. However, the unit is of a certain irreducible size dictated by the volume of the pot forming the working chamber for the ejector/pressure system to work on.

PCT/AU2007/001107 describes a scalable-output development of the above described pump wherein four pots are associated with an inlet manifold passing to respective inlets, each controlled by a knifegate valve. The lower ends of pairs of the pots pass material through respective outlet knifegate valves to respective first and second delivery lines. The respective knifegate valves and outlet knifegate valves of the pairs of pots are operable by respective common pneumatic actuators. Each pot has an ejector assembly having an upper chamber, an air injector nozzle, and an accelerator tube to create a venturi function. An air cycling valve transitions the upper chamber between a depressurized space and a pressurized space. The accelerator tube exhausts to a respective delivery line. Ejector assembly air is supplied via air control valve. The respective delivery lines each have an eductor port which allow for air to be ported into the line. The completed load and discharge cycle is governed by a pneumatic PLC and pneumatic timers. Output is scalable by operating the PLC to decommission a pair of pots or one of a pair of pots.

The scalability of output is attained at the penalty of having the footprint of 4 pots.

SUMMARY OF THE INVENTION

In one aspect the present invention resides broadly in a pneumatic evacuation pump including:

- an inlet assembly having an inlet valve interposed between an inlet accepting material from a material supply and a charging port and selectively operable purge air injection means located on the charging port side of said inlet valve;
- a chamber of selectable length and substantially constant cross section and having a charge end opening to said charging port and a discharge end; and
- a delivery assembly having a passage opening to said discharge end and extending to a delivery outlet, a delivery valve interposed in said passage between said discharge end and said delivery outlet, a selectively operable, venturi vacuum source opening to said passage between said discharge valve and said discharge end, and selectively operable exhaust air injection means located downstream of said discharge valve and utilizing exhaust air from said venturi;
- a compressed air supply supplying said venturi and said purge air injection means; and
- control means acting to coordinate a cycle of operation of said venturi vacuum source, said purge air injection means, said exhaust air injection means and said inlet and delivery valves.

The inlet assembly may be provided with any suitable connection to the material supply. For example the inlet of the inlet assembly may be configured to selectively engage a hopper outlet by a cam locking coupling arrangement. To this end the inlet may be configured to standard-bore size such as 100 mm notional bore (NB). In terms of scalability, the hopper or other material supply may include a manifold to accept two or more inlet assemblies.

The inlet valve may be of any type dictated by the material to be pumped. For example the inlet valve may be a gate, ball or other valve. For drilling applications, the valve may be a knifegate valve. The inlet valve is preferably pneumatically operated, although it is envisaged that the valve may be operated by electromechanical or hydraulic means.

The charging port may comprise merely a pipe stub extension of the inlet valve downstream port, essentially extending the port for sufficient length to allow for the selectively operable purge air injection means to be mounted on it. Alternatively, the valve body may be integrally formed with a downstream selectively operable purge air injection means. Preferably the purge air injection is angled to the axis of the charging port to direct injection air with a downstream component of direction.

The charging port may be particularly configured to engage the chamber charge end opening. For example, the respective ends may be configured as a complementary releasable locking arrangement such as a cam-lock pipe coupling, or may be configured to be joined by a conventional pipe collar clamp. The charging port is preferably of standard bore form for the reasons given below.

The chamber may be of any selected cross section but is preferably of circular cross section. For ease of supply the chamber is preferably formed of a selected length of standard bore pipe of a type known to be useful in the transport of the materials to be pumped. For example, in drilling and mining applications the chamber may be formed of a selected length of 100 mm NB steel pipe. Such pipe may be used in its default standard length of 6.5 m or may be shortened or extended by joining as required. The chamber may be formed in any other standard pipe size as required by the material and duty, such as 75 or 150 mm, or 5", etc.

The charge end opening may, as discussed above be treated to be particularly connected to the charging port. Alternatively, the connection may be selected to allow the chamber charge end opening to be a plain pipe end. By this means the selection of the length may be done in the field by simply cutting the pipe. The discharge end may be fabricated to the end of the delivery assembly passage opening. However, it is preferred that the chamber be separable from delivery assembly. Accordingly the discharge end may be particularly adapted to engage the delivery assembly, such as by a cam-lock pipe coupling, or may be configured to be joined by a conventional pipe collar clamp, or may be a plain end.

The delivery assembly may include an integral cast assembly comprising a body having the passage therethrough and incorporating a delivery valve body. Alternatively the passage may be formed by tubular stock and the valve body be fabricated to it. The delivery outlet may be provided with any suitable connection to a convey line or post-processing means such as a cyclone separator. For example the delivery outlet may be configured with a cam locking coupling arrangement. To this end the outlet, and the passage forming body per se, may be configured from standard-bore size pipe such as 100 mm NB steel pipe.

The discharge valve may be of any type dictated by the material to be pumped. For example the discharge valve may be a gate, ball or other valve. For drilling applications, the valve may be a knifegate valve. The discharge valve is preferably pneumatically operated, although it is envisaged that the valve may be operated by electromechanical or hydraulic means.

The selectively operable, venturi vacuum source may be mounted on the delivery assembly or may be in mere fluid communication with it. The venturi will generally have a high velocity air flow jet in a housing and used to generate a zone of low pressure within the housing, which is tapped by a selectively operated vacuum valve to lower the air pressure in the chamber.

The high velocity air exhausted from the venturi may be diffused to be used by exhaust air injection means to provide driving force for material on the side of the delivery line downstream of the delivery valve when the delivery valve is closed. When the delivery valve is open, application of air pressure downstream would generally be counterproductive. Accordingly the diffuser exhaust air flow is preferably closed by a diffuser valve during the discharge part of the cycle. As there is no venturi effect with nowhere for the high velocity air flow to diffuse when the diffuser valve is closed, the venturi stalls and the venturi housing pressurizes.

The vacuum valve may be open to pressurize the chamber to assist in discharge of the chamber. However, it is preferably closed to allow the purge air injection to empty the chamber and to build up the pressure in the venturi chamber to full line pressure for the downstream boost provided by exhaust air injection means. This configuration means that the venturi may be cycled by control of the vacuum and diffuser valves only, without the need for a cycling air supply valve to the venturi jet per se.

The venturi vacuum source may comprises a venturi assembly comprising a venturi housing mounting an axial venturi jet, the housing transitioning into a diffuser tube coaxial with the jet, the vacuum take off being directed laterally via a selectively operable vacuum valve to intersect the passage between the discharge valve and the discharge end. This configuration facilitates the integration of the venturi with the delivery assembly per se with the venturi jet and diffuser tube having a co-axis parallel to the delivery passage axis. From this configuration, it is geometrically straightforward to provide an exhaust air injection means comprising a simple selectively valve operated exhaust air line angled to the delivery passage axis to direct exhaust air with a downstream component of direction. The delivery assembly is, in this embodiment, an integrated, compact unit that can be easily handled.

The compressed air supply may be a conventional standard-pressure compressed air supply. The venturi and purge air injection means may be provided with manual or remote control isolator cocks as required. A notional air supply operating pressure of 825 Kpa (120 PSI) is typical, although it is envisaged that higher or lower pressures may be used.

The control means may take any suitable form such as timed-cycle or condition-responsive control means. The control means may operate the respective valves buy one or more of electromechanical, pneumatic or hydraulic means or, in each case, a combination thereof. The control means itself may be electronic or pneumatic. The control means may be a programmable logic controller.

The cycle of operation may be mediated by any suitable pre-program or condition-responsive capacity of the control means. For simplicity, where the material is reasonably consistent in composition, the cycle of operation is preferably a selectable timed cycle of operation. However, it is envisaged that the control means may accept inputs from one or more of load transducers and one or more pressure transducers to provide all or some of the control inputs.

In a typical timed-cycle type of operation, in an all-pneumatic embodiment, a compressed air supply is connected to the purge line, venturi jet and the control system. With the delivery valve closed and the vacuum valve and inlet valve both open, air passes through the venturi housing and nozzle down the diffuser tube, the exhaust air exiting through the open diffuser valve to the deliver passage downstream of the closed delivery line. This action generates a vacuum in the venturi housing and causing air to be evacuated from the chamber. Product is drawn into the chamber through the inlet assembly under this vacuum and any head of pressure provided by hopper of lance to the incoming material.

In a typical control system, once time has elapsed to enable the chamber to fill, a time governed by variable pneumatic timers, a signal is sent to a control solenoid system which in turn closes the vacuum, inlet and diffuser valves. The delivery valve opens and the purge valve opens enabling compressed air to exert pressure on the contents of the chamber which in turn ejects the captured material via the delivery valve and the connecting discharge pipe. The cycle is timed out and the process is repeated.

For example, when compressed air is supplied to both the venturi and purge lines, air may also supplied to a remote control box. The compressed air may be ported to energise both a timer block and its solenoid and a dual actuator control solenoid, porting air to open the diffuser valve, operate a discharge valve actuator to close, and open a vacuum valve actuator. Air may be ported to energise a solenoid mounted on the inlet valve knifegate actuator and spring defaulted in the inlet knifegate valve open position. Air then activates a discharge cycle timer, travels via a pneumatic line to activate a solenoid which ports air to the open port of the delivery valve actuator and to the close port of the vacuum valve actuator.

Signal air is simultaneously supplied to a solenoid which in turn ports air to the close port on the inlet valve knifegate actuator. A position indicator micro switch located on the closed side of the knifegate and constantly energised, actuates and opens the purge valve allowing compressed air to enter the chamber and expelling the contents.

Once the pneumatic discharge timer times out, air is then redirected via a solenoid to the load timer, air passes through and activates the load timer and is terminated. With the signal removed the discharge valve actuator solenoid and the inlet valve actuator solenoid and their respective actuators along with the diffuser and purge valves return to their default positions. Once the load timer times out the cycle is repeated

BRIEF DESCRIPTION OF THE DRAWINGS

The invention will be described with reference to the following non-limiting embodiment of the invention as illustrated in the drawings and wherein:

In FIGS. 1 and 2 there is provided a pneumatic evacuation pump including an inlet assembly (10), an elongate, cylindrical chamber (11) and a delivery assembly (12).

Figure 1:
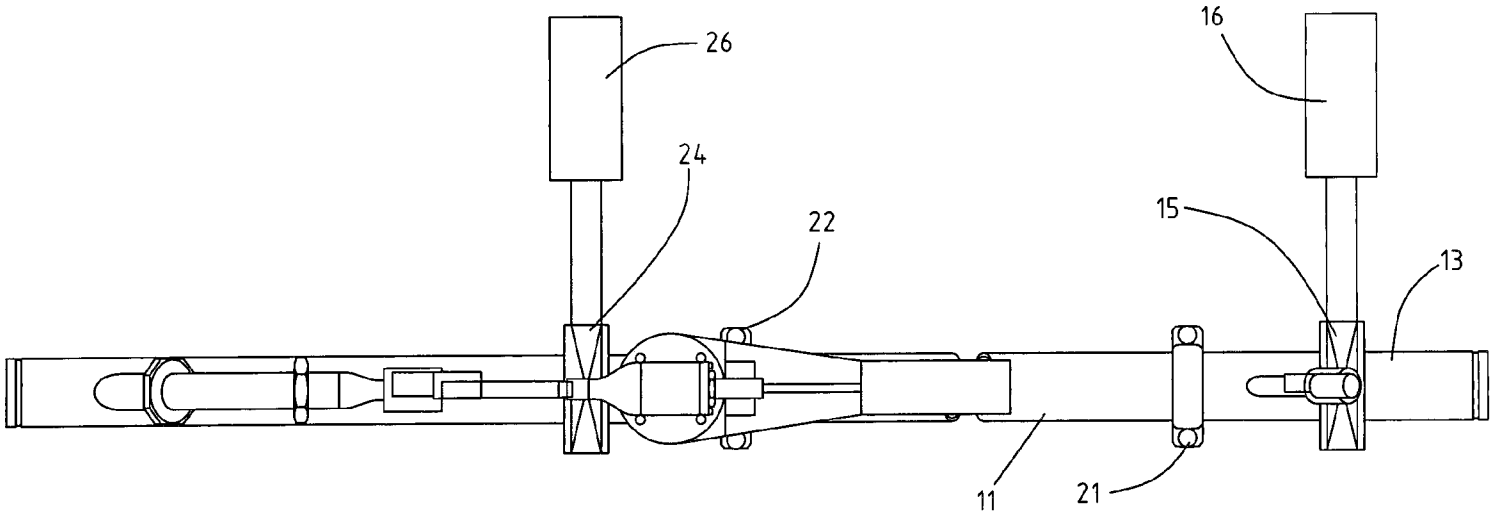
FIG. 1 is a plan view of apparatus in accordance with the present invention.
Figure 2:
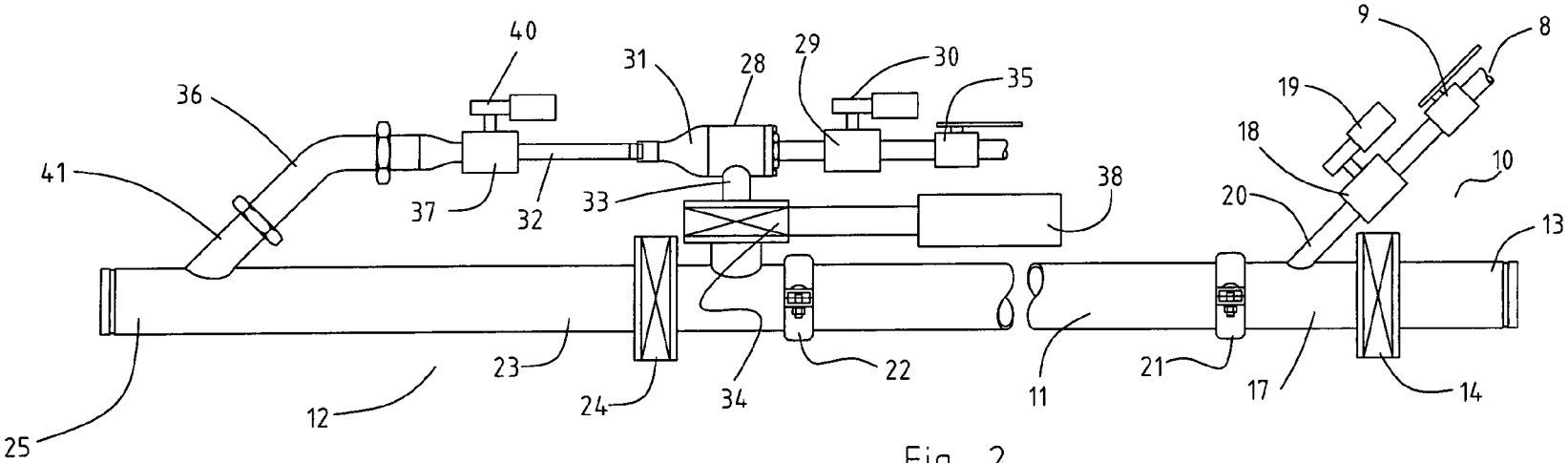
FIG. 2 is an elevation of the apparatus of FIG. 1.

The inlet assembly (10) includes an inlet end (13) configured to selectively engage a hopper outlet (not shown) by a 100 mm NB cam-lock coupling arrangement. The inlet assembly (10) includes an inlet valve assembly (14) comprising a knifegate inlet valve (15) operated by a pneumatic actuator (16).

The downstream side of the inlet valve assembly (14) mounts a charging port (17) comprising a pipe stub extending for sufficient length to allow for a purge air injection line (20) to be mounted. The purge air injection line (20) is angled to the axis of the charging port (17) to direct injection air with a downstream component of direction. The purge air injection line (20) is supplied via a compressed air source (8) supplied via a master air cock (9) and a selectively operable purge air ball valve (18) operated by a purge valve actuator (19).

The charging port (17) has an end formed to engage a charge end of the chamber (11) and be secured thereto by a pipe collar clamp (21).

The chamber (11) is of steel pipe of 100 mm NB and is formed from standard pipe for transport of entrained drilling particles. The discharge end of the chamber (11) is configured to be joined to the delivery assembly (12) by a conventional pipe collar clamp (22).

The delivery assembly (12) is formed of 100 mm NB tubular steel stock pipe (23) fabricated to a delivery valve (24). The delivery outlet end (25) is configured with a cam locking coupling end. The delivery valve (24) is a knifegate valve operated by a pneumatic actuator (26).

A venturi assembly (27) comprises a venturi housing (28) mounting an axial venturi jet (31), the housing (28) transitioning into a diffuser tube (32) coaxial with the jet (31), a vacuum take off (33) being directed laterally via a selectively operable vacuum valve (34) tapping in to and supported on the pipe (23) between the delivery valve (24) and the discharge end of the chamber (11). The vacuum take off (33) supports the venturi housing (28) on the pipe (23). The jet (31) is supplied with compressed air via a venturi ball valve (30) operated by venturi ball valve actuator 29. The vacuum valve (34) is operated by a pneumatic vacuum valve actuator (38).

A flexible exhaust air line (36) connects a diffuser ball valve (37), mounted on the end of the diffuser tube (32) and selectively operable by a diffuser valve actuator (40), to an angled spigot (41) fabricated to and providing an air injection point into the region of the delivery outlet end (25). The spigot (41) is angled to the delivery passage axis to direct exhaust air with a downstream component of direction.

In use, a compressed air supply is connected to both the master air cock (9) and master venturi cock (35) which are both manually or remotely opened to permit operation of the apparatus. With delivery valve (24) closed and vacuum valve (34) and inlet valve (15) open (the default valve position), and the venturi ball valve 30 receives a signal to open, air passes through the venturi housing (28) and venturi jet (31) down the diffuser tube exiting through V3 to the flexible exhaust air line (36) into the angled spigot (41). This action generates a vacuum in the venturi housing (28) causing air to be evacuated from the chamber (11). Product is drawn into chamber (11) through a connecting flexible hose and material lance (not shown) under both vacuum and the corresponding airflow generated by the rapidly evacuated air.

Once chamber (11) is full, an action governed by the variable pneumatic timers, a signal is sent to the control solenoid this in turn closes vacuum valve (34), inlet valve (15) and venturi ball valve (30) With delivery valve (24) opened a signal is sent to purge air ball valve (18) which is opened. Compressed air is ported through purge air ball valve (18) exerting pressure on the contents of chamber (11) which are inturn ejects the captured material via delivery valve (24) and the connecting discharge pipe. The cycle is timed out and the process is repeated.

The chamber (11) in this embodiment is 100 mm NB and is 6.5 meters long. The notional operating pressure of 825 Kpa (120 PSI) is used in this embodiment.

Figure 3:
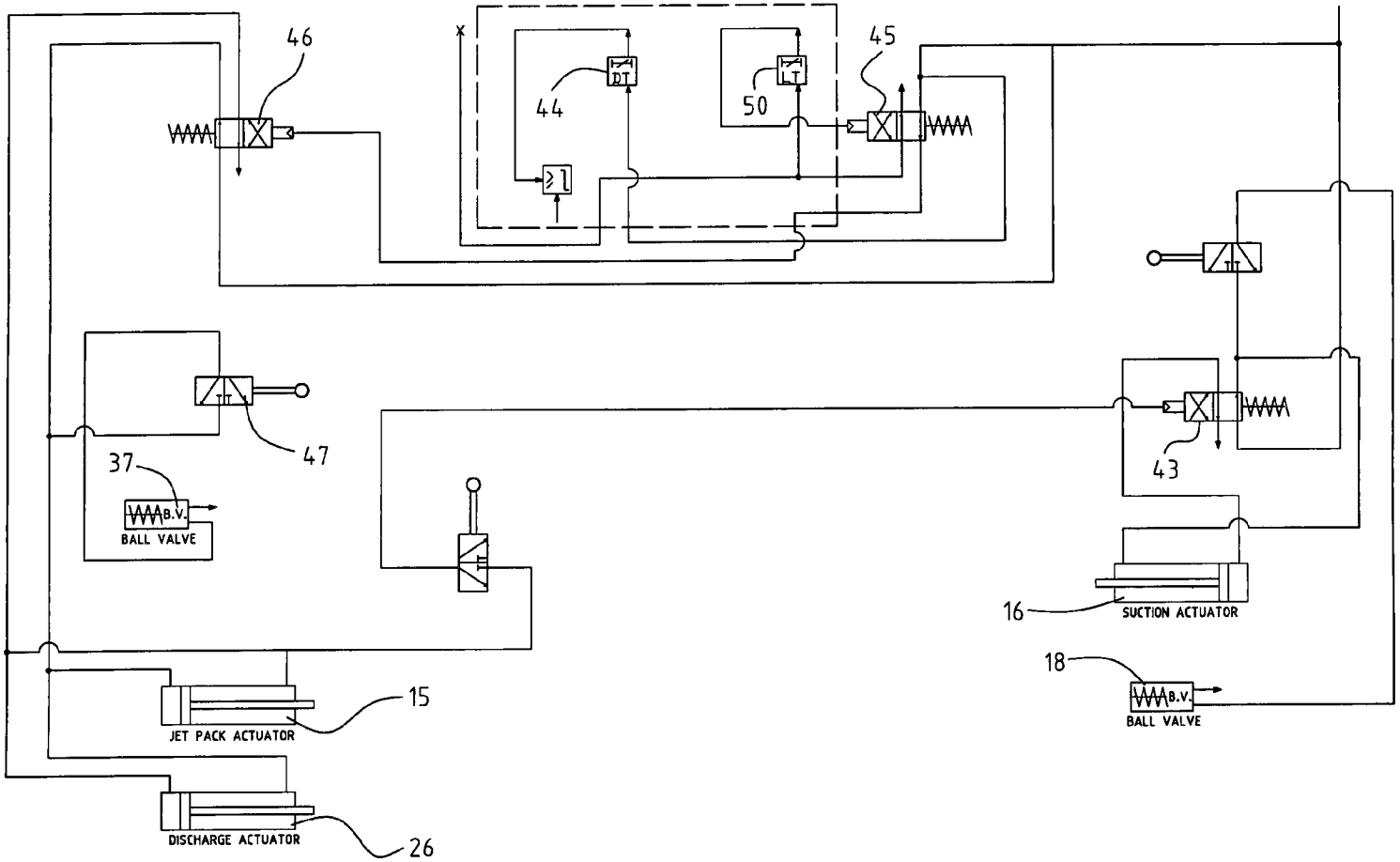
FIG. 3 is a schematic drawing of a control system for the apparatus of FIG. 1.

Referring to FIG. 3, compressed air is supplied to both a remote control box (42) and a solenoid (43) mounted on pneumatic actuator (16). Compressed air is ported via pneumatic fittings and line to energise both the discharge timer (44) and its controlling solenoid (45) and the dual actuator control solenoid (46) also located within the control enclosure. The dual actuator control solenoid (46) is energised, porting air to close the diffuser ball valve (37), the delivery pneumatic actuator (26) closed port, and the vacuum valve actuator (38) open port. Air is simultaneously ported to energise solenoid (43) mounted on the inlet knifegate valve actuator (16) with solenoid (43) spring defaulted in the inlet knifegate valve (15) open position.

Air enters and activates the discharge cycle timer (44). Air then travels via a pneumatic line to the dual actuator control solenoid (46). The dual actuator control solenoid (46) is activated and ports air to the open port of the delivery pneumatic actuator (26) and to the closed port of pneumatic vacuum valve actuator (38). Signal air is simultaneously supplied to solenoid (43) which inturn ports air to the closed port on inlet valve actuator (16), a position indicator micro switch (47) located on the closed side of the suction inlet knifegate valve (15) and constantly energised, actuates and opens the purge air ball valve (18) once made, and compressed air then enters chamber (11) via purge air ball valve (18) expelling the contents of the chamber (11).

Once the pneumatic discharge timer times out, air is then redirected via timer solenoid (45) to the load timer (50), air passes through and activates the load timer (50) and is terminated. With the signal removed the dual actuator control solenoid (46) and the solenoid (43) and their respective actuators (26), (38) and (16) along with the diffuser ball valve (37)

and purge air ball valve (18) return to their default positions. Once the load timer times out the cycle is repeated Apparatus in accordance with the foregoing embodiment has the specific advantages of being scalable by both selection of the length of the chamber (11), by adding multiple units and by altering the program parameters on the pneumatic control. The apparatus is very portable when broken down into its three major components (10), (11) and (12). The apparatus has a less obstructive footprint than pot-based pumping apparatus. The present embodiment enables the relatively simple conversion of a standard length of any APL5 Standard pipe into a vacuum loading pressure discharge solids pump. The concept readily converts to fit both various pipe materials and configurations including radius bends etc.

The unit is 100% air powered and operated and is intrinsically safe.

It will of course be realised that while the above has been given by way of illustrative example of this invention, all such and other modifications and variations thereto as would be apparent to persons skilled in the art are deemed to fall within the broad scope and ambit of this invention as is set forth in the claims appended hereto.

The invention claimed is:

1. A pneumatic evacuation pump for transporting material from a material supply using air from a compressed air supply, the pneumatic evacuation pump comprising:

a material inlet configured to receive the material from the material supply;

an inlet valve configured to controllably restrict flow of the material through the material inlet;

a chamber disposed downstream of the inlet valve, the chamber extending along a chamber axis between the inlet valve and a delivery valve, the delivery valve being configured to controllably restrict flow of material out of the chamber;

a purge air injection assembly in communication with the compressed air supply and including a purge air injection line configured to direct the air from the compressed air supply to the chamber, via a purge air inlet, with a downstream component of direction relative to the chamber axis;

a passage extending along a passage axis between the delivery valve and a discharge end, the passage axis being aligned with the chamber axis;

a vacuum assembly including a venturi jet within a housing, the venturi jet being in communication with the compressed air supply such that, when air flows from the compressed air supply through the venturi jet, the venturi jet generates a zone of low pressure within the housing;

a vacuum valve disposed downstream of the purge air inlet and upstream of the delivery valve, the vacuum valve configured to controllably restrict flow from the chamber to the vacuum assembly such that, when air flows from the compressed air supply through the venturi jet and the vacuum valve is open, the zone of low pressure within the housing lowers air pressure in the chamber;

a diffuser tube disposed downstream of the venturi jet to receive exhaust air from the venturi jet;

a flexible exhaust line disposed downstream of the diffuser tube to direct the exhaust air from the diffuser tube to the passage, via a passage inlet disposed downstream of the delivery valve, with a downstream component of direction relative to the passage axis;

a diffuser valve disposed downstream of the diffuser tube and upstream of the passage inlet and the flexible exhaust line, the diffuser valve being configured to controllably restrict flow of the exhaust air from the venturi jet to the passage inlet via the diffuser tube; and a controller configured to coordinate a cycle of operation of the vacuum valve, diffuser valve, inlet valve, and delivery valve.

2. A pneumatic evacuation pump according to claim 1, wherein the material inlet is configured from APL5 Standard pipe.

3. A pneumatic evacuation pump according to claim 1, wherein the inlet valve is a knifegate valve.

4. A pneumatic evacuation pump according to claim 3, wherein the inlet valve is pneumatically operated.

5. A pneumatic evacuation pump according to claim 1, wherein at least part of the purge air injection assembly is angled relative to the chamber axis.

6. A pneumatic evacuation pump according to claim 1, wherein the chamber is formed of a selected length of standard bore pipe of a type known to be useful in the transport of the materials to be pumped.

7. A pneumatic evacuation pump according to claim 6, wherein the chamber is formed of a selected length of 100 mm NB steel AP5 Standard pipe.

8. A pneumatic evacuation pump according to claim 1, wherein the delivery valve is a pneumatically actuated knifegate valve.

9. A pneumatic evacuation pump according to claim 1, wherein exhaust air from the venturi jet is diffused by the diffuser tube to provide driving force for material downstream of the delivery valve when the delivery valve is closed.

10. A pneumatic evacuation pump according to claim 6, wherein the vacuum valve directs flow laterally from the chamber to the vacuum assembly.

11. A pneumatic evacuation pump according to claim 10, wherein at least part of the flexible exhaust line is angled relative to the passage axis.

12. A pneumatic evacuation pump according to claim 1, wherein the controller utilizes timed-cycle or condition-responsive control schemes.

13. A pneumatic evacuation pump according to claim 12, wherein the controller is pneumatic and operates the respective valves pneumatically.

14. A pneumatic evacuation pump according to claim 12, wherein the cycle of operation is a selectable timed cycle of operation.

* * * * *